US007007334B2

(12) United States Patent
Thurnher

(10) Patent No.: US 7,007,334 B2
(45) Date of Patent: Mar. 7, 2006

(54) CLEANING DEVICE FOR THE SURFACE OF A FACADE

(76) Inventor: Julius Thurnher, Friedrich Schlöglgasse 4, Purkersdorf (AT) A-3002

( * ) Notice: Subject to any disclaimer, the term of this patent is extended or adjusted under 35 U.S.C. 154(b) by 481 days.

(21) Appl. No.: 10/149,802

(22) PCT Filed: Dec. 11, 2000

(86) PCT No.: PCT/AT00/00333

§ 371 (c)(1),
(2), (4) Date: Sep. 27, 2002

(87) PCT Pub. No.: WO01/43614

PCT Pub. Date: Jun. 21, 2001

(65) Prior Publication Data

US 2003/0140438 A1 Jul. 31, 2003

(30) Foreign Application Priority Data

Dec. 16, 1999 (AT) ..... 2125/99

(51) Int. Cl.
*A47L 1/02* (2006.01)

(52) U.S. Cl. ..... 15/103; 15/250.11; 15/250.24

(58) Field of Classification Search ..... 15/103, 15/98–99, 250.24, 250.11, 250.29, 50.1
See application file for complete search history.

(56) References Cited

U.S. PATENT DOCUMENTS 1,410,487 A * 3/1922 McCarty ..... 15/250.05
1,766,550 A * 6/1930 Schubert ..... 15/250.04
1,803,722 A * 5/1931 Moon ..... 15/250.24
3,354,494 A * 11/1967 Rischman ..... 15/250.24
3,378,875 A * 4/1968 Kern ..... 15/250.04
4,257,138 A 3/1981 Clements et al. ..... 15/4
5,323,508 A * 6/1994 Sheldrake ..... 15/250.22
5,353,466 A * 10/1994 Smith et al. ..... 15/250.003
5,699,576 A 12/1997 Sohalby ..... 15/103
5,707,455 A * 1/1998 Tomita ..... 134/18
6,851,156 B1 * 2/2005 Hairaton ..... 15/250.01
2003/0145410 A1 * 8/2003 Butindari ..... 15/250.01

FOREIGN PATENT DOCUMENTS

| | | |
|---|---|---|
| DE | 3923070 | 1/1991 |
| DE | 19847239 | 4/2000 |
| EP | 0047344 | 3/1982 |
| EP | 0302343 | 2/1989 |
| EP | 0709054 | 5/1996 |

(Continued)

*Primary Examiner*—John Kim
*Assistant Examiner*—Laura C Cole
(74) *Attorney, Agent, or Firm*—Collard & Roe, P.C.

(57) ABSTRACT

A cleaning device (9) for a facade surface (3) of a building (1), comprising at least one elongate wiper strip unit (10) movable back and forth along at least one guide rail unit (6) by means of a stationarily arranged drive motor (45), the wiper strip unit extending at right angles to the guide rail unit (6), and comprising at least one cleaning fluid line (29) with which spray nozzles (31) directed towards the surface (2) to be cleaned are connected; for a simple, space-saving design thereof, the wiper strip unit (10) includes at least one carrier (19) slidingly guided in the guide rail unit (6), the carrier being tightly connected to a linear driving element (32), e.g. a toothed belt (33) that is movable along the guide rail unit (6), the stationarily arranged drive motor (45) being associated with this driving element.

18 Claims, 7 Drawing Sheets

FOREIGN PATENT DOCUMENTS

Figure 1:
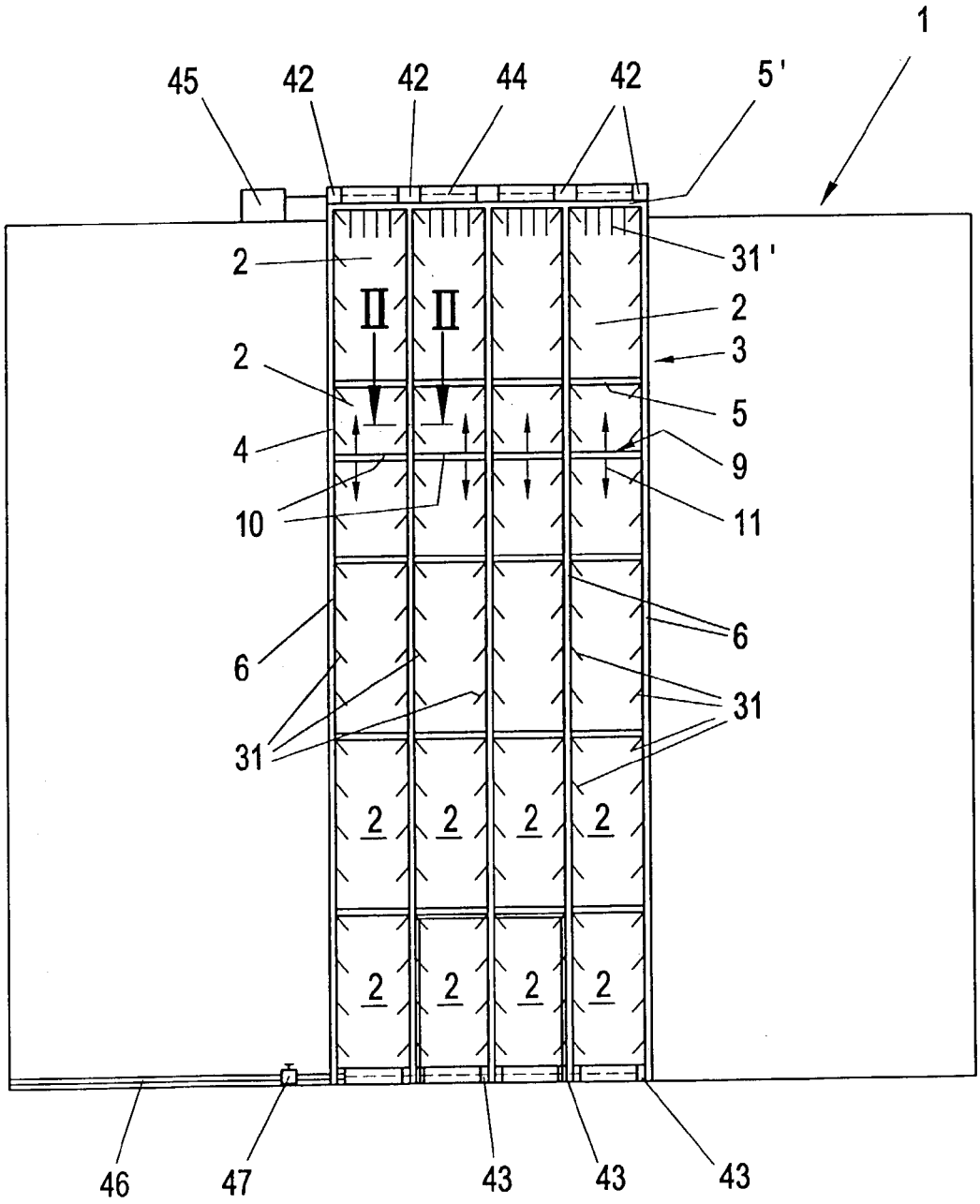

| | | |
|---|---|---|
| GB | 1231251 | 5/1971 |
| GB | 2330297 | 4/1999 |
| JP | 09195520 | 7/1997 |
| WO | WO 0101840 | 1/2001 |

* cited by examiner

CLEANING DEVICE FOR THE SURFACE OF A FACADE

CROSS REFERENCE TO RELATED APPLICATIONS

Applicants claim priority under 35 U.S.C. §119 of Austrian Application No. A2125/99 filed on 16 Dec. 1999. Applicants also claim priority under 35 U.S.C. §120 of PCT/AT00/00333 filed on 11 Dec. 2000. The international application under PCT article 21(2) was not published in English.

The invention relates to a facade cleaning device for a facade surface of a building, and comprising at least one elongate wiper strip unit movable back and forth along at least one guide rail unit by means of a stationarily arranged drive motor, the wiper strip unit extending at right angles to the guide rail unit, and further comprising at least one cleaning fluid line with which spray nozzles directed towards the surface to be cleaned are connected.

Such a cleaning device is known from EP 709 054 A, wherein, in one embodiment of this known cleaning device, the wiper strip unit is horizontally moved over the height of the facade and, in another one, is vertically moved along guide rails which are mounted on the facade. The wiper strip unit of this known cleaning device is equipped with separate motors so as to drive the wiper strip unit along the guide rails in which driven toothed wheels engage with a stationary toothed rail, on the one hand, and a pump, on the other hand so as to spray cleaning fluid via the spray nozzles provided in the region of the wiper strip against the surface to be cleaned. This known cleaning device thus is quite complex in its construction, the expenditures being even the higher as several such cleaning devices are adjacently arranged per facade and in each of these cleaning devices a wiper strip unit equipped with its own motor drive etc. is present. Moreover, the wiper strip units displaceable in the manner of a carriage are comparatively voluminous, due to the installation of both motors as well as of the pump for the cleaning fluid, wherein, however, it would be desirable for the cleaning devices not, or not substantially, to impair the appearance of the building facades.

From EP 0 047 344 A1 a window cleaning device is known in which a spraying and/or wiping unit is displaceable along the window pane by aid of a spindle and a nut mounted on the spindle, which nut is rigidly connected to the spraying and wiping unit, respectively. Such a spindle drive is comparatively complex and massive, and this is the more so if a spindle drive has to extend over the entire height of a building—in the case of a facade cleaning device—resulting also in a high risk of self-locking.

In U.S. Pat. No. 4,257,138 A, a comparable automatic window cleaning device is described in which a cleaning unit is mounted for displacement by spindles arranged on both sides of a window pane. In addition, a brush unit is provided which is rotatably driven via a bevel gear drive. Here, too, a complex construction of the drive of the cleaning unit is the result.

In DE 39 23 070 A, a window cleaning device comprising a cleaning element movably arranged on a window frame is shown, which cleaning element includes a brush between two rubber strips. A cleaning solution is laterally supplied into the space between the rubber strips, which cleaning solution, however, particularly in case of larger widths of the area to be cleaned, is only unevenly distributed over the respective width.

Finally, from EP 302 343 A, a window cleaning arrangement, particularly for motor vehicles, is known in which a windshield wiper is movable back and forth along a windshield by aid of two counter-rotating belts serving as driving means. By aid of counter-rotating belts, an inclined positioning of the windshield wiper is to be enabled, resulting, however, in quite a complex driving means which is suitable for small window panes only.

It is now an object of the invention to provide a cleaning device of the initially defined type, which has a simple and efficient design, requires little space so that it is hardly noticeable on the facade of a building and which, moreover, is also capable of being retrofitted to already existing facades of buildings. Moreover, the risk of a jamming or self-locking of the drive should be low.

The inventive cleaning device of the initially defined type is characterized in that the wiper strip unit includes at least one carrier slidingly guided in the guide rail unit, the carrier being fixedly connected to a linear driving element that is movable along the guide rail unit, the stationarily arranged drive motor being associated with this driving element. With such a construction, the aforementioned aim is met in an advantageous manner, wherein particularly the wiper strip unit can be kept comparatively compact and small since it need not accommodate any drive units. The linear driving element which is driven to move back and forth is received in the drive rail unit, and it may, e.g., be a driving rope, a driving belt or the like, preferably a toothed belt; this driving element is fixedly coupled to the carrier of the wiper strip unit which thereby is driven by the driving element to move back and forth and in its movement entrains the wiper strip unit proper along the facade surface to be cleaned. Thus, the risk of a self-locking of the drive can be substantially reduced as compared to known spindle drives, whereby also time and costs for any possible repair and maintenance work are reduced. In small embodiments it would in theory be conceivable that such a carrier is provided only on one side of the wiper strip unit, so that the wiper strip unit will freely cantilever from the carrier, i.e. from the guide rail unit; this would, above all, be conceivable in that case in which the back and forth movement of the wiper strip unit with the carrier is horizontal. Preferably, however—with a view to the then simpler guide construction—a vertical movement of the wiper strip unit is provided for, with the wiper strip unit also having an appropriate width for the cleaning of larger facade surfaces in one cleaning procedure so that then it will be suitable to arrange carriers on both ends of the wiper strip unit so as to guide the wiper strip unit on both sides in guide rail units. The driving elements in the guide rail units may be driven from a common stationary drive motor via appropriate gears and shafts so that the respective expenditures will additionally be reduced, apart from the fact that a stationarily arranged drive motor already helps reduce the construction expenses required for the cleaning device.

As has already been mentioned, the driving element might, e.g., be a rope or a belt, wherein it would, moreover, be conceivable to reel this driving element off drums, or to wind it up on drums, when the wiper strip unit is to be moved back and forth. For an efficient, space-saving design, it has, however, proven particularly suitable if the driving element is an endless driving element which is wound about two wheels or the like stationarily arranged beyond the points of reversal of the movement stroke of the wiper strip unit, one of these wheels being drivable by the drive motor.

If the wiper strip is designed with an appropriately stiff strip body or carrier body, it may directly be connected to the carrier, obviating any further constructive measures for attachment of the wiper strip. However, to allow for the wiper strips, which will be worn during operation, to be designed as simple wearing parts, as well as also with a view to a covering desired for reasons of protection as well as for optical reasons, it is, however, of particular advantage if the carrier is connected to a housing of the wiper strip unit, in which a wiper strip is mounted which projects with a longitudinal side thereof through a slot opening of the housing. To allow for an equallization of mounting tolerances in the region of the guide rail units as well as of the carriers guided therein which might possibly lead to slightly varying spacings between the guide rail units, it is, furthermore, suitable if the housing is connected to the carrier so as to be displaceable in its longitudinal direction, e.g. via a pin/long hole arrangement.

For the wiper strip to be easily movable over obstacles present on the facade surface to be cleaned, without excessive wear of the wiper strip, it is, moreover, advantageous if the wiper strip is received in the housing so as to be movable towards and away from the surface to be cleaned. With a view to a simple, effective construction it is, furthermore, suitable if the wiper strip is resiliently biased in the direction towards the slot opening of the housing. For obtaining a controlled evasion movement of the wiper strip, it is particularly advantageous if the wiper strip is connected to a cam follower laterally projecting from the housing through an opening thereof, which cam follower optionally has at least one associated control cam which is arranged in the region of a facade part that projects horizontally relative to the plane of the surface to be cleaned, such as a joining section between panes of glass, the wiper strip being rearwardly movable in the housing by the cam follower moved via the control cam, when the wiper strip is travelling over the projecting facade part. To achieve an easy movement it is, furthermore, advantageous if the cam follower is designed with a freely rotatably mounted roller. For reasons of a simplified mounting it is, furthermore, suitable if the control cam is mounted on the guide rail unit.

For an efficient coupling of the carrier with the driving element it has also proven suitable if the carrier is designed with several, e.g. two, tightly interconnected clamping parts between which the driving element is fixed. Furthermore, for a safe entrainment of the carrier and avoiding of slippage, it is particularly advantageous if one of the clamping parts includes a toothed rail part fixedly arranged thereon, which is engaged with the toothed belt provided as the driving element.

For a simple design and mounting of the guide rail unit it is, furthermore, advantageous if the guide rail unit is formed by interconnected sections defining several channels, the carrier being guided in one channel and projecting outward from the guide rail unit through a longitudinal slot. In particular, it is suitable if the guide rail unit includes a base section adapted to be fastened to the facade and a cover section connected to the base section, which cover section contains a receiving channel provided for the cleaning fluid line and closed by a lid ledge.

In the present cleaning device, the spray nozzles may suitably be stationarily mounted on sections or the like provided on the facade. It is, e.g., conceivable to mount the spray nozzles stationarily on joining sections respectively present above or between the glass surfaces of the facade of the building, in case the wiper strip unit moves in vertical direction. For a particularly simple mounting, in particular at a later installation on an already existing building, it has, however, proven advantageous if the spray nozzles are stationarily arranged on the guide rail unit. If the guide rail unit is configured as a base section, cover section and lid section, it is, furthermore, suitable if the spray nozzles are mounted on the lid ledge and connected to the cleaning fluid line through this lid ledge. In this instance, the nozzle openings of the spray nozzles are directed towards the respective associated facade surface to be cleaned, and for cleaning, cleaning pressurized fluid is supplied by aid of a stationary pump, by opening a valve, e.g. a solenoid valve, in the supply line.

To equalize a possible pressure drop which results with an increasing distance of the spray nozzles from the cleaning fluid pump, it is, furthermore, advantageous if the spray nozzles have nozzle cross-sections varying along the guide rail unit and/or have varying mutual spacings.

To keep the returning side of an endless driving element away from the carrier, if such an endless driving element is used, and if oscillations were to occur in the driving element during the starting movements or when stopping the wiper strip unit, it is also suitable if the base section defines a guide channel with at least one ledge projection of L-shaped cross-section for the returning side of the endless driving element.

To counteract an undesired entry of humidity, in particular also of cleaning fluid, in the mounting region of the guide rail unit, it is finally advantageous if the base section has receiving channels for seals at its rear side facing away from the cover section.

Figure 2:
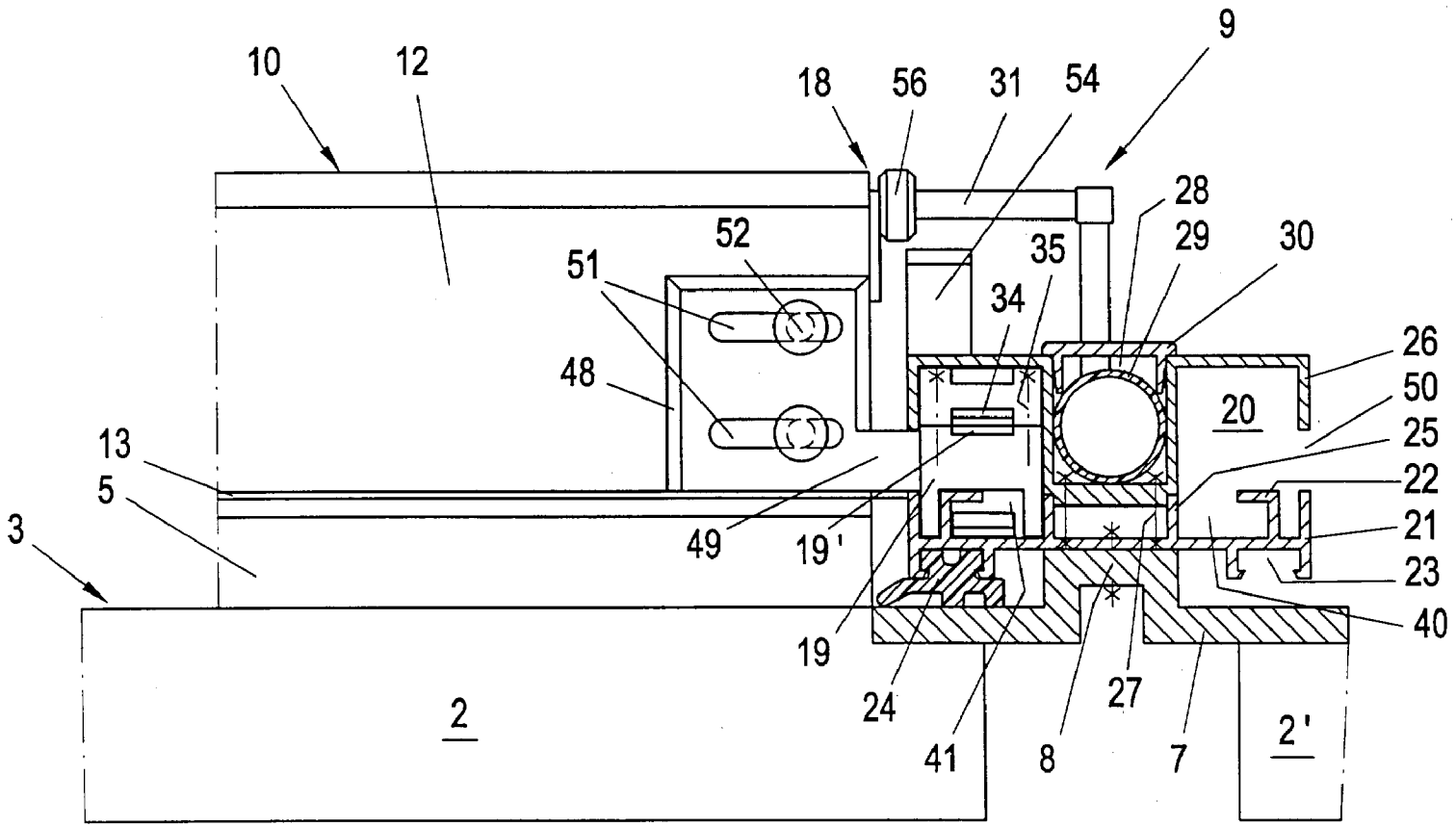
Figure 3:
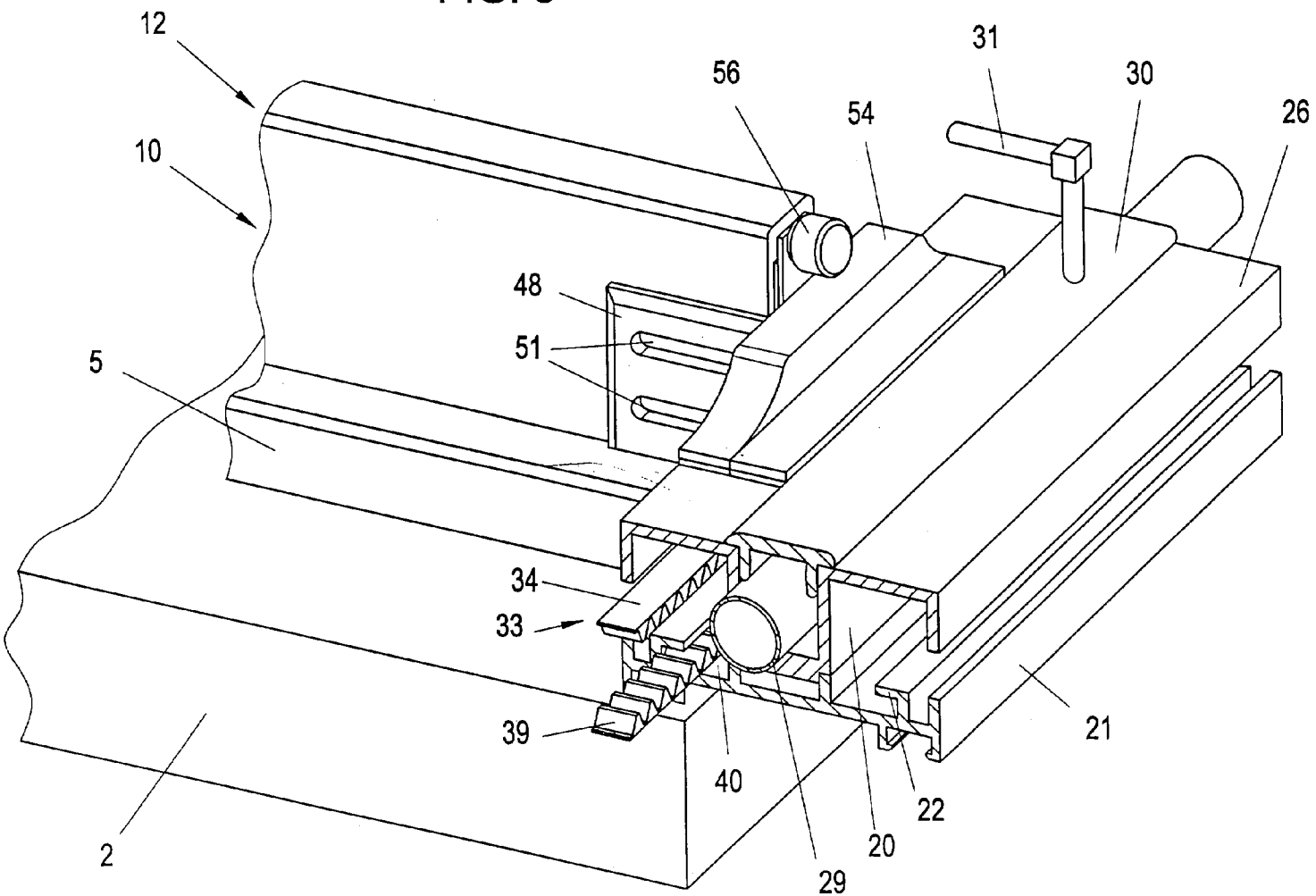
Figure 4:
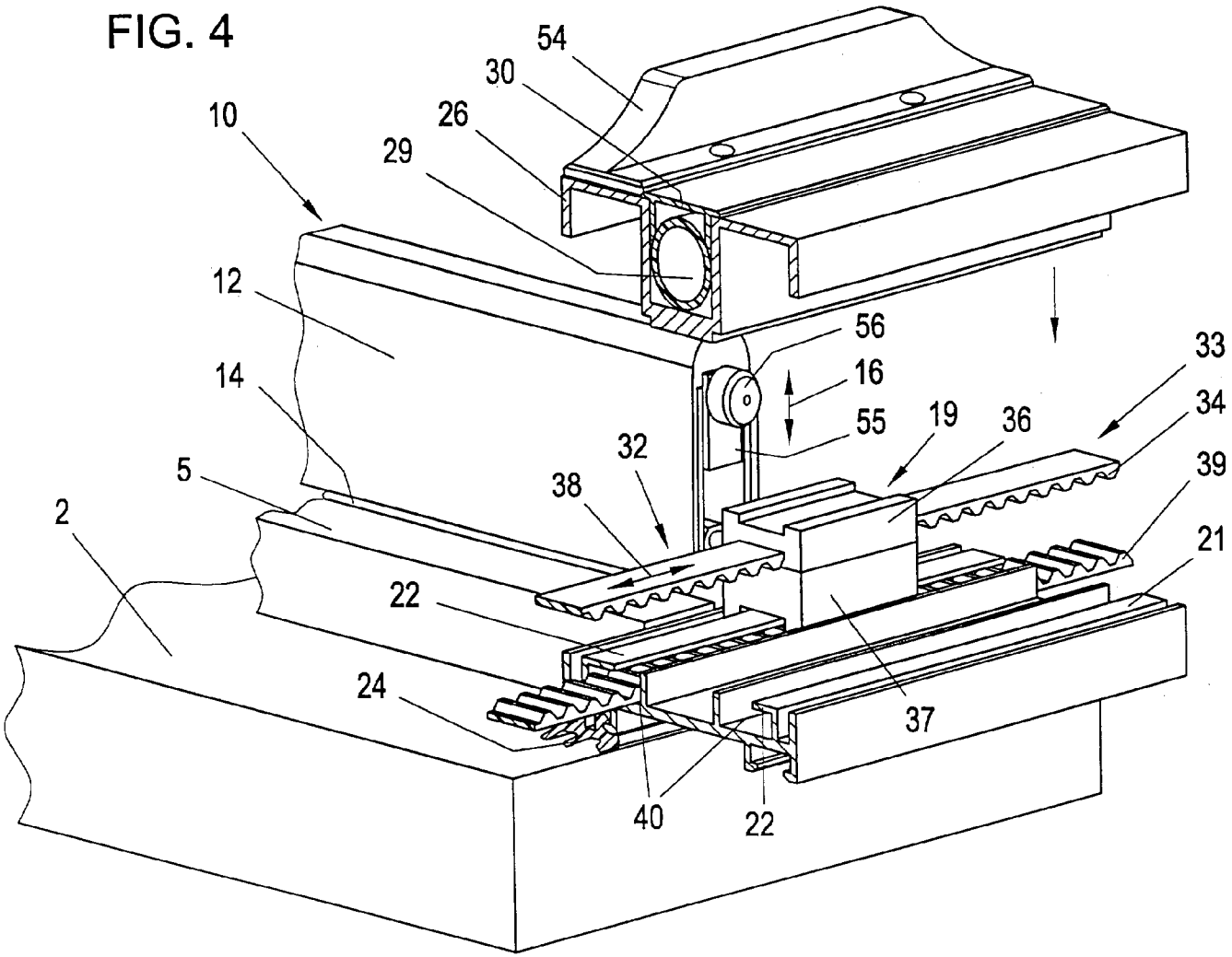
Figure 5:
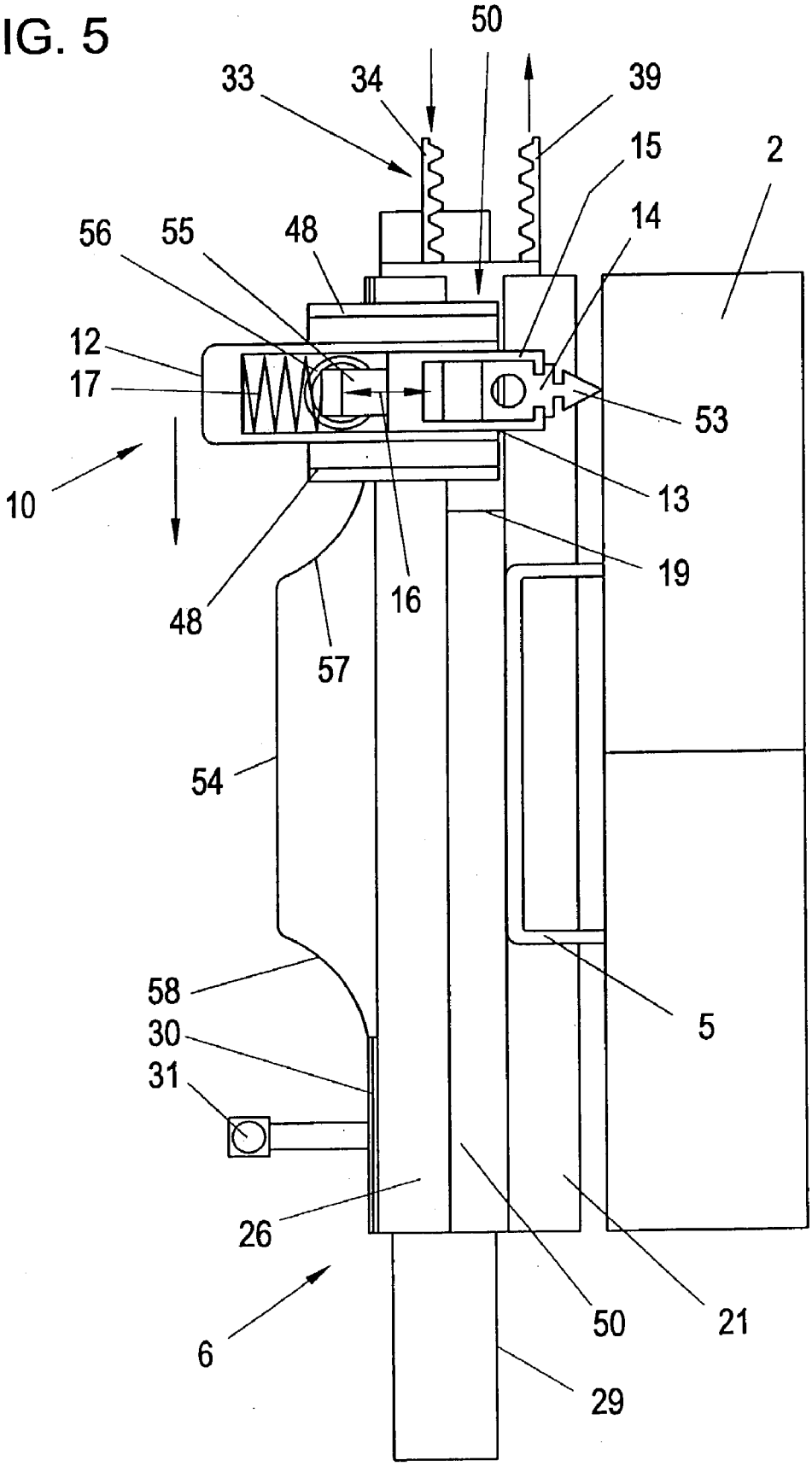
Figure 6:
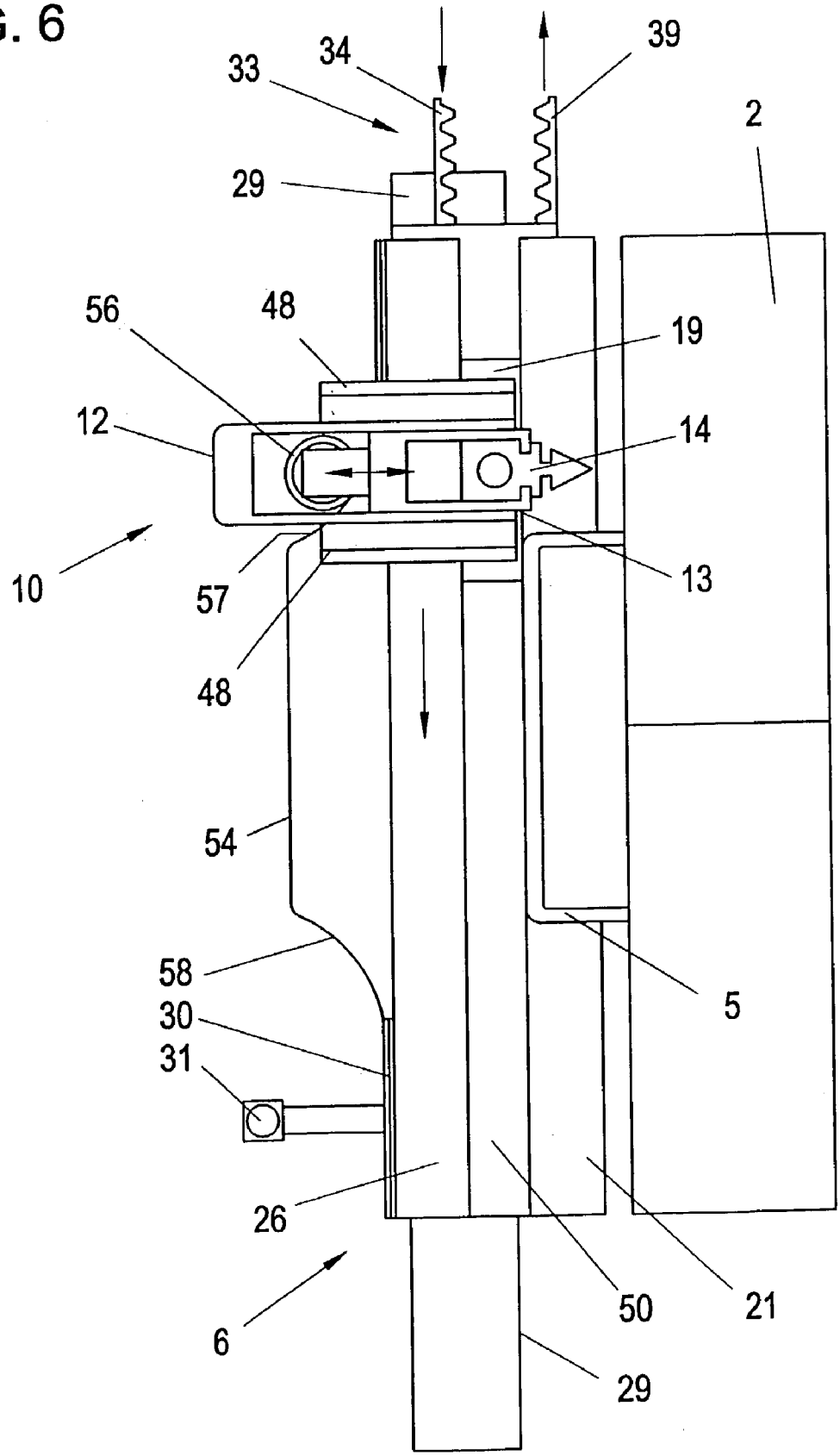
Figure 7:
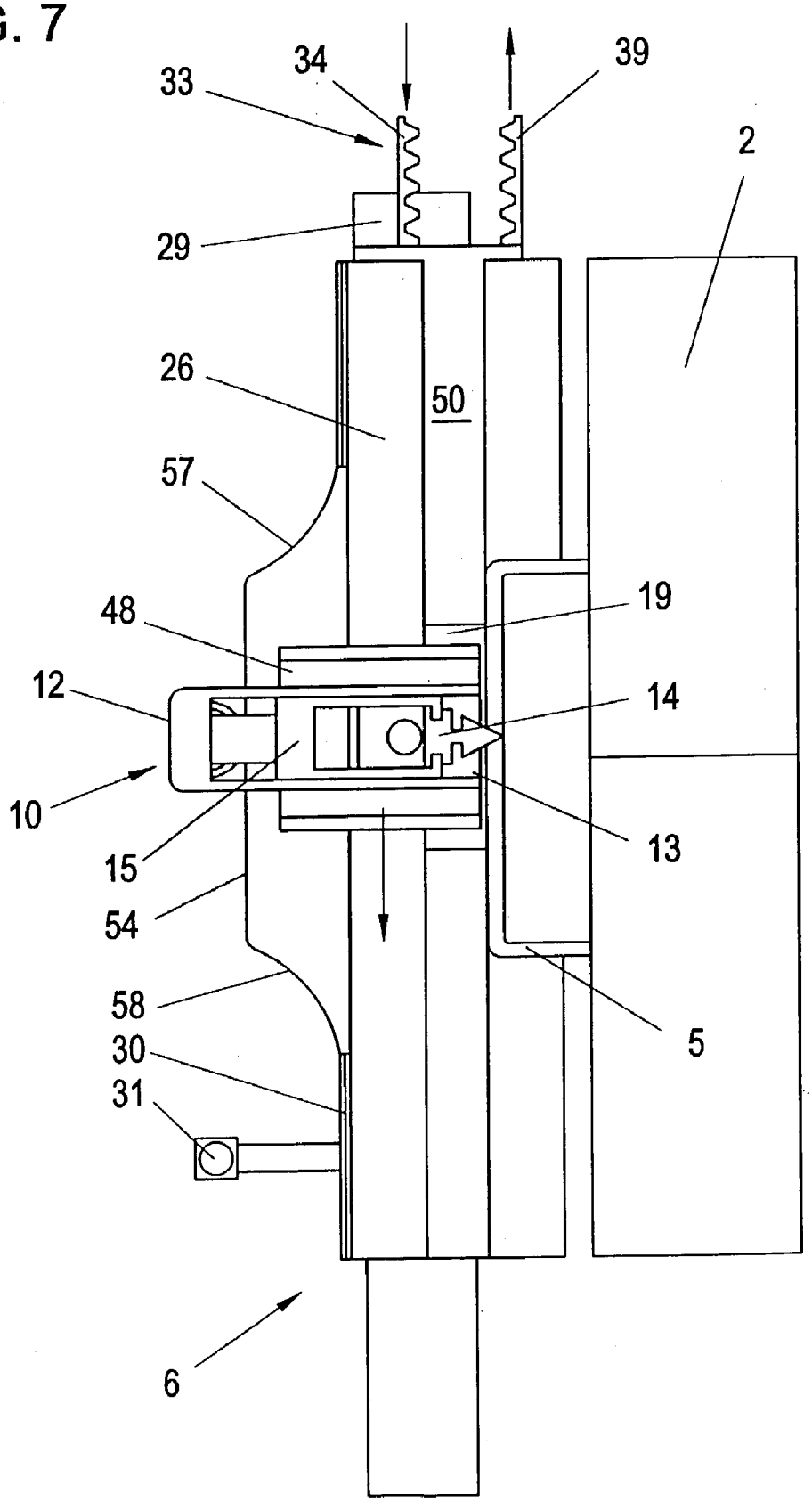

In the following, the invention will be explained in more detail by way of the preferred exemplary embodiments illustrated in the drawings to which, however, it shall not be restricted. In detail, FIG. 1 shows a schematic view of a facade of a building including glass surfaces to be cleaned, with cleaning devices provided per vertical glass surface row, the cleaning devices including vertically displaceable wiper strip units;

FIG. 2 shows a schematic horizontal partial section through such a cleaning device, approximately according to line II—II of FIG. 1, with a broken away depicted wiper strip unit on a glass surface merely schematically illustrated;

FIG. 3 shows a perspective view of the part of the cleaning device visible in FIG. 2, in a slant top view, FIG. 4 shows a schematic, partially exploded view of the cleaning device according to FIGS. 2 and 3, and FIGS. 5, 6 and 7 show schematic end views of a wiper strip unit above a portion of a facade surface to be cleaned, when travelling over an obstacle, i.e. a projecting facade part, on the facade surface, FIG. 5 showing the situation before travel over the obstacle has begun, FIG. 6 showing the initial phase of travelling as controlled by a control cam, and FIG. 7 showing the wiper strip in the position completely lifted by the control cam, when the obstacle is being travelled over.

In FIG. 1, a view of a building 1 comprising glass surfaces 2 to be cleaned provided on a facade surface 3 is quite schematically illustrated. The glass surfaces 2 are separated from each other, or laterally delimited, respectively, by vertical section rails 4 as well as by horizontal abutments or joining sections 5. The vertical section rails 4 form guide rail units 6 visible in more detail in FIGS. 2 and 3, which extend continuously over the entire height of the facade 3 and which—as visible in FIG. 2—are fastened on, e.g. screwed to, joining sections 7 interconnecting the individual glass surfaces 2, as schematically indicated at 8 in FIG. 2.

The guide rail units 6 belong to cleaning devices 9 which include one wiper strip unit 10 each which are upwardly and downwardly displaceable along the guide rail units 6, as indicated by arrows 11 in FIG. 1. According to FIG. 2, each wiper strip unit 10 is provided with a wiper strip or blade 14 passing from a narrow (cf. also FIG. 3), ledge-shaped housing 12 at its narrow side facing the associated glass surface 2 through a slot opening 13 (cf. FIG. 5), which wiper strip or blade 14 according to FIG. 5 is provided with a section enclosure and arranged in the housing 12 to be horizontally movable back and forth, as indicated by double arrow 16 in FIGS. 4 and 5.

As furthermore schematically illustrated in FIG. 5, the wiper strip section enclosure 15 may be loaded into the outward position by one or more helical pressure springs 17, wherein a stop not illustrated in detail in the drawing may delimit, in a per-se conventional manner, the outward movement of the wiper strip 14 including its section enclosure 15 out of housing 12. As will be explained in more detail hereinafter by way of FIGS. 5 to 7, this horizontal movability of the wiper strip 14 in an advantageous manner allows for a controlled travel over obstacles on the facade surface 3 during upward and downward travel of the wiper strip unit 10 of the cleaning device 9.

On each of its end sides, e.g. 18 in FIG. 2, the wiper strip unit 10 is slidingly guided in its associated guide rail unit 6 by aid of a carrier 19. For this purpose, each guide rail unit 6 is designed with channels 20 extending vertically over the entire facade height, one carrier 19 each of a wiper strip unit 10 being slidingly guided in each one of these vertical channels 20, as is particularly visible in FIG. 2 in case of the carrier 19 shown there in the left-hand channel 20 within guide rail unit 6. The right-hand channel 20 in FIG. 2 is illustrated empty for greater clarity, and at this side no wiper strip unit has been illustrated above the neighbouring glass surface 2'. However, the next wiper strip unit 10 would, of course, follow there and would be slidingly guided by a corresponding carrier 19 in (right-hand) channel 20.

For forming channels 20, each guide rail unit 6 has a base section 21 fastened to the afore-mentioned joining section 7 e.g. by means of screws 8. This base section 21 has L-shaped ledge projections or webs 22, one of them each projecting into a vertical channel 20; the purpose of these webs 22 shall be explained in more detail hereinafter. At the inner side facing facade 3, the base section 21 moreover is provided with hook-shaped section projections provided in pairs which in pairs form receiving channels 23 for seals 24. This allows for a sealed arrangement of base section 21 on facade 3.

A cover section 26 abuts on central, web-type projections 25 of base section 21, which cover section in its central region is tightly connected to the base section 21, e.g. by means of screws 27, after the respective carrier 19 has previously been mounted in the associated channel 20, cf. in this context also the exploded illustration of FIG. 4.

Cover section 26 has a central receiving channel 28 in which a cleaning fluid line 29, e.g. in the form of a hose, is received. When the cleaning fluid line 29 has been mounted in receiving channel 28, the latter is closed by a lid ledge 30 which may be provided in lengths abutting each other in end to end relationship and which is provided with spray nozzles 31 having nozzle openings directed towards the respective glass surface 2 to be cleaned, cf. also FIG. 1, where such spray nozzles 31 are schematically indicated, in addition to FIGS. 2 and 3. These spray nozzles 31 are thus stationarily attached on the guide rail units 6, and when the glass surfaces 3 of facade surface 3 are to be cleaned, they are supplied with cleaning fluid, in particular water, under pressure via lines 29 by aid of a pump not illustrated in detail in the drawing, so that the cleaning fluid is sprayed onto the glass surfaces 2. Subsequently, the wiper strip units 10 will travel from top to bottom—preferably together, in a line, as illustrated in FIG. 1, thereby cleaning the glass surfaces 2; in the subsequent upward stroke, the wiper strip units 10 will wipe the glass surfaces 2 more or less dry, thereby providing cleaned and dry glass surfaces after this work cycle.

For this upward and downward travel of the wiper strip units 10 under the guidance of their carriers 19 in channels 20 of the guide rail units 6, an endless driving element 32, e.g. in the form of a toothed belt 33, is provided for each carrier 19. With its one side (run) 34, this toothed belt 33 is fixed between two fixedly connected, e.g. screwed together (as indicated in FIG. 2 at 35), clamping parts 36, 37 of the carrier that is designed in two parts, cf. also FIG. 4, so that the toothed belt 33, when it moves back and forth (cf. also double arrow 38 in FIG. 4) with its side 34 entrains the carrier 19 without slippage upwards and downwards to thereby move the wiper strip 10 which is tightly connected to the carrier 19 upwards and downwards along the facade. The one clamping part 37 may be equipped, or designed, respectively, with a fixed toothed rail part 19' with which the toothed belt 33 engages.

The idle side 39 of toothed belt 33 runs back free of contact with the carrier 19 in the respective channel 20, the previously mentioned ledge projections 22 of L-shaped cross-section in pairs each forming a guide channel 40 for this returning side 39. The leg of the ledge projection 22 extending in parallel to the facade surface 3 delimits the guiding channel 40 towards the respective carrier 19 so that the side 39 of toothed belt 33 is kept away from carrier 19, or its inner clamping part 37, respectively—which is provided with a corresponding cut-out 41, cf. FIG. 2.

As merely quite schematically indicated in FIG. 1, toothed wheels 42, or 43, respectively, are provided for the endless toothed belts 33 at the upper side of the facade surface 3 just as on the lower side thereof, over which the end-less toothed belts 33 are wound; these toothed wheels 42, 43 may each be seated on a shaft and thus co-rotate; at least it is provided that the one, e.g. upper, toothed wheels 42 are seated on a common drive shaft which is only quite schematically indicated by a broken line 44 and which is driven by an also only quite schematically illustrated stationarily mounted motor 45.

Besides, in FIG. 1 a supply line 46 with a shutoff valve 47 for the cleaning fluid to the spray nozzles 31 is shown. Moreover, it is shown that in addition to or instead of the spray nozzles 31 on the vertical guide rail units 6, downwardly directed spray nozzles 31' may also be provided on horizontal joining sections 5, or on the uppermost section 5', respectively, for applying cleaning fluid to the glass surfaces 2. Even though this is not illustrated in FIG. 1, such spray nozzles 31 may, moreover, be mounted on the intermediate joining sections 5, between the glass surfaces 2, and this not only downwardly oriented, but also with upwardly oriented nozzle openings.

As furthermore is visible in FIG. 2, the carrier 19 has a plate-shaped fastening part 48 which is fixedly connected to the one clamping part 37 of carrier 19 via a connecting web 49 that projects through a lateral, vertically extending longitudinal slot 50 between the two sections 21, 26 of guide rail unit 6. Plate 48 is provided with long holes 51 extending in longitudinal direction of the wiper strip unit 10, a pin 52—merely schematically illustrated in FIG. 2—being received in each of the long holes 51, which pin is fixedly connected to the housing 12 of the wiper strip unit 10, ensuring a horizontal movability of housing 12 relative to carrier 19 by this pin/long hole arrangement 52, 51. Of course, such a pin/long hole arrangement 52, 51 is required on one side of the wiper strip unit 10 only, whereas on the other, non-illustrated side of the wiper strip unit 10 the plate 48 may be fixedly connected to the housing 12, e.g. by screwing or also by welding or riveting. By the horizontal movability provided by the pin/long hole arrangement 52, 51, any possible production and mounting tolerances can be equalized during attachment of the guide rail units 6 on facade 3, if, on account of these tolerances, the respective neighbouring guide rail units 6 between which the respective wiper strip unit 10 extends did not have a constant distance over the entire height of building 1.

As has already been previously mentioned, the wiper strip 14 is arranged in the housing 12 of the wiper strip unit 10 so as to be inwardly and outwardly displaceable, the spring 17 pressing the wiper strip 14 outwards, i.e. towards the glass surface 2. In this way, the wiper strip 14 is capable of moving into the housing 12 in case of obstacles present on the facade surface 3 so that its front blade part 53 (cf. FIG. 5) will be protected. To control this retraction movement, control cams 54 may be attached on the guide rail unit 6 in the region of such obstacles, i.e. projecting facade parts, on the facade surface 3, which are formed e.g. by the previously mentioned horizontal joining sections 5 between the glass surfaces 2, cf. in particular also FIGS. 3 and 4 as well as FIGS. 5 to 7. These control cams 54 may each be mounted on the cover section 26, e.g. screwed thereto. The section enclosure 15 of the respective wiper strip 14 is furthermore tightly connected to a bearing part 55 for a freely rotatable roller 56 provided as a cam follower. During upward and downward movement of the wiper strip unit 10, when the toothed belt 33 is driven, roller 56 thus runs up against the respective control cam 54 which is designed with corresponding ramps 57, 58, and thereby lifts the wiper strip 14 off the glass surface 2 or, more precisely, off the obstacle, i.e. the joining section 5, cf. the different phases of this lifting and travel according to FIGS. 5, 6 (where roller 56 is just rolling over the upper ramp 57) and FIG. 7 (according to which roller 56 has completely retracted the wiper strip 14). Subsequently, the pressure spring only illustrated in FIG. 5 presses the wiper strip 14, as it is moving over the ramp 58 towards the guide rail unit 6, again towards the glass surface 2 so that it can continue its cleaning activity there.

The spray nozzles 31 may have varying nozzle cross-sections or spacings over the height of building 1 so as to equalize a pressure drop that results over the height of line 29, or facade 3, respectively; accordingly, in the arrangement according to FIG. 1, the spray nozzles 31 may be the more closely arranged, the higher they are arranged, and they may also have smaller nozzle openings for the cleaning fluid to be sprayed sufficiently far onto the glass surfaces 2 even at greater heights.

What is claimed is:

1. A cleaning device for a facade surface of a building, comprising at least one elongate wiper strip unit movable back and forth by means of a stationarily arranged drive motor along at least one guide rail unit provided on the facade surface, the wiper unit extending at right angles to the guide rail unit, and comprising at least one cleaning fluid line with which spray nozzles directed towards the facade surface to be cleaned are connected, characterised in that the wiper strip unit (10) includes at least one carrier (19) slidingly guided in the guide rail unit (6) being fixedly connected with a linear driving element (32) that is movable along the guide rail, the stationarily arranged drive motor (45) being associated with the driving element, the carrier (19) being connected with a housing (12) of the wiper strip unit (10), in which a wiper strip (14) is mounted which projects with a longitudinal side thereof through a slot opening (13) of the housing (12), the wiper strip being received in the housing (12) as as to be movable towards and away from the facade surface (2) and being connected to a a cam follower laterally projecting from the housing (12) through an opening thereof, which cam follower has at least one associated control cam which is arranged in the region of a facade part that projects horizontally relative to the plane of the facade surface (2) to be cleaned, the wiper strip (14) being rearwardly movable in the housing (12) by the came follower moved via the control cam when the wiper strip travels over the projecting facade part.

2. A cleaning device according to claim 1, characterised in that a toothed belt (33) is provided as the driving element (32).

3. A cleaning device according to claim 1, characterised in that the driving element (32) is an endless driving element which is wound about two wheels or the like (42, 43) stationarily arranged beyond points of reversal of a movement stroke of the wiper strip unit (19), one of these wheels being drivable by the drive motor (45).

4. A cleaning device according to claim 1, characterised in that the housing (12) is connected with the carrier (19) 50 as to be displaceable in its longitudinal direction.

5. A cleaning device according to claim 1, characterised in that the wiper strip (14) is resiliently biased in a direction towards the slot opening (13) of the housing (12).

6. A cleaning device according to claim 1, characterised in that the cam follower is designed with a freely rotatably mounted roller.

7. A cleaning device according to claim 1, characterised in that the control cam is mounted on the guide rail unit (6).

8. A cleaning device according to claim 1, characterised in that the guide rail unit (6) is formed by interconnected sections (21, 26) defining several channels (20, 28), the carrier (19) being guided in one channel (20) and projecting outward from the guide rail unit through a longitudinal slot.

9. A cleaning device according to claim 1, characterised in that the spray nozzles (31) are stationarily arranged on the guide rail unit (6).

10. A cleaning device for a facade surface of a building, comprising at least one elongate wiper strip unit movable back and forth by means of a stationarily arranged drive motor along at least one guide rail unit provided on the facade surface, the wiper unit extending at right angles to the guide rail unit, and comprising at least one cleaning fluid line with which spray nozzles directed towards the facade surface to be cleaned are connected, characterised in that the wiper strip unit (10) includes at least one carrier (19) slidingly guided in the guide rail unit (6) being fixedly connected with a linear driving element (32) that is movable along the guide rail, the stationarily arranged drive motor (45) being associated with the driving element, the carrier (19) being connected with a housing (12) of the wiper strip unit (10), in which a wiper strip (14) is mounted which projects with a longitudinal side thereof through a slot opening (13) of the housing (12), and the housing (12) being connected with the carrier (19) by a pin and long hole arrangement (52, 51) so as to be displaceable in its longitudinal direction.

11. A cleaning device for a facade surface of a building, comprising at least one elongate wiper strip unit movable back and forth by means of a stationarily arranged drive motor along at least one guide rail unit provided on the facade surface, the wiper unit extending at right angles to the guide rail unit, and comprising at least one cleaning fluid line with which spray nozzles directed towards the facade surface to be cleaned are connected, characterised in that the wiper strip unit (10) includes at least one carrier (19) slidingly guided in the guide rail unit (6) being fixedly connected with a linear driving element (32) that is movable along the guide rail, the stationarily arranged drive motor (45) being associated with the driving element, and the carrier (19) being designed with several tightly interconnected clamping parts (36,37) between which the driving element (32) is fixed.

12. A cleaning device according to claim 11, characterised in that the carrier (19) is designed with two clamping parts (36, 37).

13. A cleaning device according to claim 11, characterised in that one of the clamping parts (37) includes a toothed rail part (19') fixedly arranged thereon, which is engaged with the toothed belt (33) provided as the driving element (32).

14. A cleaning device for a facade surface of a building, comprising at least one elongate wiper strip unit movable back and forth by means of a stationarily arranged drive motor along at least one guide rail unit provided on the facade surface, the wiper unit extending at right angles to the guide rail unit, and comprising at least one cleaning fluid line with which spray nozzles directed towards the facade surface to be cleaned are connected, characterised in that the wiper strip unit (10) includes at least one carrier (19) slidingly guided in the guide rail unit (6) being fixedly connected with a linear driving element (32) that is movable along the guide rail, the stationarily arranged drive motor (45) being associated with the driving element, the guide rail unit (6) including a base section (21) adapted to be fastened to the facade and a cover section (26) connected to the base section, which cover section contains a receiving channel (28) provided for the cleaning fluid line (29) and closed by a lid edge.

15. A cleaning device according to claim 14, characterised in that the base section (21) defines a guide channel (40) with at least one ledge projection (22) of L-shaped cross-section for a returning side (39) of the endless driving element (32).

16. A cleaning device according to claim 14, characterised in that the base section (21) has receiving channels (23) for seals (24) at its rear side facing away from the cover section (26).

17. A cleaning device for a facade surface of a building, comprising at least one elongate wiper strip unit movable back and forth by means of a stationarily arranged drive motor along at least one guide rail unit provided on the facade surface, the wiper unit extending at right angles to the guide rail unit, and comprising at least one cleaning fluid line with which spray nozzles directed towards the facade surface to be cleaned are connected, characterised in that the wiper strip unit (10) includes at least one carrier (19) slidingly guided in the guide rail unit (6) being fixedly connected with a linear driving element (32) that is movable along the guide rail, the stationarily arranged drive motor (45) being associated with the driving element, and the spray nozzles (31) being stationarily arranged on the guide rail unit (6) and mounted on a lid ledge (30) and connected to the cleaning fluid line (29) through the lid ledge (30).

18. A cleaning device according to claim 17, characterised in that the spray nozzles (31) have nozzle cross-sections varying along the guide rail unit (6).

* * * * *